United States Patent [19]

Mowill

[11] Patent Number: 4,678,396

[45] Date of Patent: Jul. 7, 1987

[54] MOVABLE SPIKE, VARIABLE ENTRANCE GEOMETRY PIPE DIFFUSER WITH VIBRATION SUPPRESSION

[75] Inventor: Rolf J. Mowill, Oslo, Norway

[73] Assignee: A S Kongsberg Vapenfabrikk, Kongsberg, Norway

[21] Appl. No.: 716,146

[22] Filed: Mar. 26, 1985

Related U.S. Application Data

[60] Continuation-in-part of Ser. No. 577,383, Feb. 6, 1984, Pat. No. 4,573,868, which is a division of Ser. No. 438,990, Nov. 4, 1982, Pat. No. 4,549,847.

[51] Int. Cl.[4] ..... F04D 29/46

[52] U.S. Cl. ..... 415/148; 415/119; 415/157; 415/167; 138/45

[58] Field of Search ..... 415/119, 181, 148, 150, 415/157, 158, 167; 60/39.29, 751; 137/15.1, 15.2, 331; 138/45, 46

[56] References Cited

U.S. PATENT DOCUMENTS

| | | | |
|---|---|---|---|
| 2,557,435 | 6/1951 | Imbert | 239/265.25 |
| 2,810,545 | 10/1957 | Buchi | 415/148 |
| 2,831,505 | 4/1958 | Menard | 138/45 |
| 2,947,136 | 8/1960 | Hausmann | 60/39.29 X |
| 3,768,507 | 10/1973 | Dicken, Jr. | 138/45 X |
| 3,841,789 | 10/1974 | Corrigan et al. | 415/148 |
| 3,908,694 | 9/1975 | Spears | 138/46 X |
| 4,375,939 | 3/1983 | Mount et al. | 415/157 |

FOREIGN PATENT DOCUMENTS

| | | |
|---|---|---|
| 994841 | 11/1951 | France . |
| 998465 | 1/1952 | France . |
| 792831 | 3/1958 | United Kingdom . |

*Primary Examiner*—Robert E. Garrett
*Assistant Examiner*—Joseph M. Pitko
*Attorney, Agent, or Firm*—Finnegan, Henderson, Farabow, Garrett & Dunner

[57] ABSTRACT

A movable spike, variable entrance geometry annular pipe-type diffuser has, for prevention and suppression of flow-induced vibrations, a gear assembly for imparting rotational motion about the axis of a rod member supporting the spike in the diffuser channel, and damper guides fixed to the spike and cooperating with guide slots in the diffuser housing for opposing the rotational motion to create a biasing torque between the spike and housing to increase rigidity and damping.

13 Claims, 4 Drawing Figures

MOVABLE SPIKE, VARIABLE ENTRANCE GEOMETRY PIPE DIFFUSER WITH VIBRATION SUPPRESSION

BACKGROUND OF THE INVENTION

This application is a continuous-in-part of Ser. No. 577,383 filed Feb. 6, 1984, now U.S. Pat. No. 4,573,868 which was a division of Ser. No. 438,990 filed Nov. 4, 1982, now U.S. Pat. No. 4,549,847.

Field of the Invention

The present invention relates to pipe or channel-type diffuser apparatus for use in converting high velocity gas exiting a rotary compressor, to relatively low velocity, thereby converting kinetic energy to pressure energy.

Description of the Prior Art

It is well known in the art of rotary compressors that most applications call for a reduction in the relatively high velocities of the gases exiting from such compressor apparatus for subsequent utilization, such as in power producing gas turbine engines. To achieve the conversion of the kinetic energy of the high velocity gases to a pressure increase in the gas, diffusers are currently employed downstream of the compressors to achieve the conversion via a subsonic diffusion process. Vane-type diffusers, diffusing scrolls, and pipe or channel-type diffusers are the principle types of apparatus conventionally utilized with rotary compressors to achieve the desired kinetic energy conversion.

Pipe-type compressor diffusers have an advantage over vane-type diffusers in that they can provide a better structural member for the compressor and related components in certain applications, such as gas turbine engines. Furthermore, as a result of the discrete spacing of such pipe-type diffusers about the axis of a rotary compressor, such diffusers allow for inter-channel spacings where various conduits for gas and oil can be passed for use elsewhere in the system.

SUMMARY OF THE INVENTION

In accordance with the present invention as embodied and broadly described herein, the diffuser apparatus of the present invention for use in conjunction with a compressor comprises a housing having a diffusion channel with an axis and a cross-sectional flow area smoothly increasing in the flow direction, the housing also having an entrance for receiving gas at a relatively high velocity from the compressor. The diffuser apparatus also includes means for adjusting the channel flow area, wherein the area adjusting includes a spike member having a contoured axisymmetric face with an axially varying cross-sectional area and positioned for presenting the contoured face to oppose the gas flowing in the entrance to the housing, and means for changing the axial position of the spike member along the channel axis to selectively vary the flow area of the channel. Importantly, the diffuser apparatus further includes means for constraining the spike member against flow-induced vibrations in the channel.

Preferably, the constraining means includes means for imparting a torque on the spike member about the channel axis, and also means interconnecting the spike member and the housing for opposing said torque.

It is also preferred that the diffuser apparatus further include a rod member connected to the spike member, and rod support means for allowing both axial and rotational movement of the rod member. The position changing means can then include rod drive means for engaging a portion of the rod member distant from the spike member for imparting axial movement thereto. The constraining means can then include means for rotating the engaged rod portion about the channel axis following axial rod motion to a desired spike member location.

It is also preferred that the interconnection means includes at least two guide elements fixed to the spike member and having tip portions extending transverse to the channel axis, and an equal number of guide slots formed in the diffuser housing for slidably receiving the respective guide element tips. Each guide slot is sized to permit essentially only axial movement and is formed with opposing guide surfaces for contacting the respective guide element tip and restraining the tip against rotational movement about the channel axis.

It is also preferred that the interconnection means include means for radially centering the spike member in the channel.

It is still further preferred that the spike member is substantially torqued against the housing only when the spike member is at rest with respect to axial movement.

The accompanying drawings which are incorporated and constitute a part of this specification, illustrate one embodiment of the invention and, together with the description, serve to explain the principles of the invention.

Reference will now be made in detail to the present preferred embodiment of the invention, an example of which is illustrated in the accompanying drawings.

DESCRIPTION OF THE PREFERRED EMBODIMENT

Figure 1:
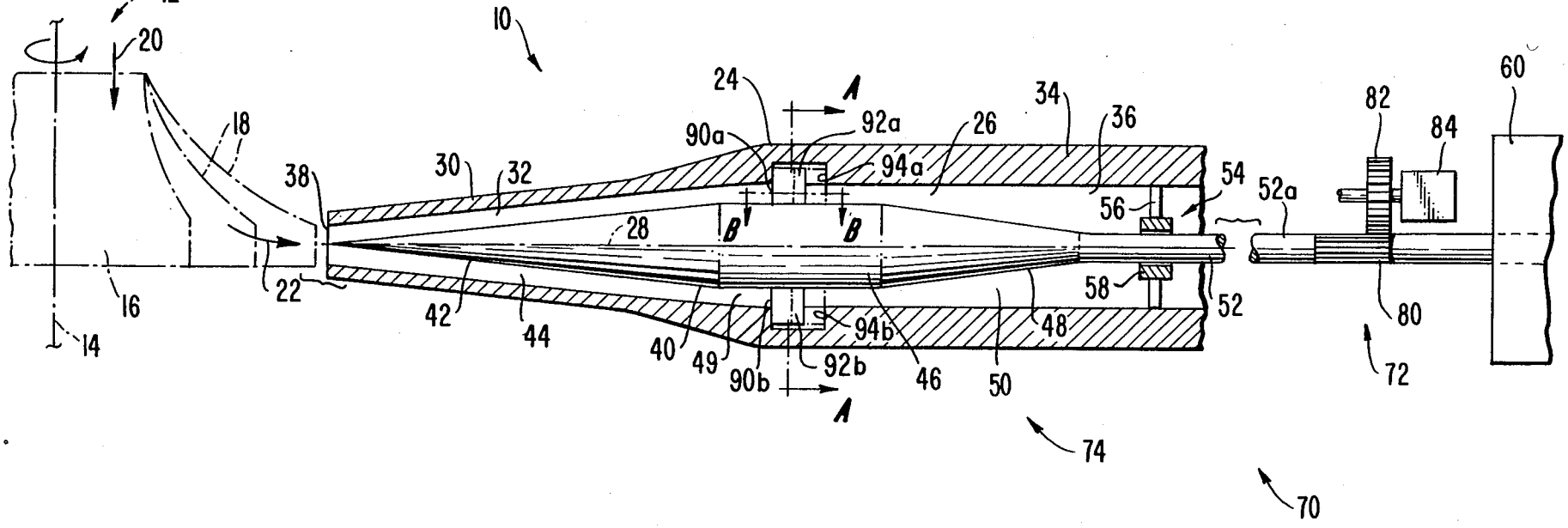
FIG. 1 is a schematic cross-sectional view of a diffuser unit constructed in accordance with the present invention and is shown in use with a centrifugal compressor.

FIG. 1 shows a pipe-type diffuser unit made in accordance with the present invention and designated generally by the numeral 10 being used in conjunction with a rotary compressor 12. Compressor 12 is of the single entry centrifugal type having axis rotation 14 for impeller component 16 having blades 18 mounted thereon. As is shown schematically in FIG. 1, air enters blades 18 in the axial direction (the entrance flow being designated by arrow 20) and leaves the impeller generally in the radial direction (flow arrow designated 22) at a high velocity. Diffuser unit 10 functions to increase the static pressure by converting the kinetic energy of the air to potential (pressure) energy, as is well understood by those skilled in the art.

In accordance with the present invention, the diffuser apparatus includes a housing having an entrance for receiving gas admitted at a relatively high velocity from the compressor. As embodied herein, diffuser unit 10 includes housing 24 having an inner through-bore 26 with an axis 28. In the embodiment shown in FIG. 1, housing 24 includes housing portion 30 with a conical bore portion 32 positioned immediately upstream of housing portion 34 with a straight bore portion 36. The transition between the bore portions 32 and 34 should be smooth and continuous.

Housing 24 includes entrance 38 for receiving high velocity gas such as the air from compressor 12. Entrance 38 is positioned adjacent to the tips of blades 18 to provide close hydrodynamic coupling between the compressor and the diffuser. Typically, a plurality of diffuser units 10 will be arranged in a plane perpendicular to centrifugal compressor axis 14, with the respective diffuser axis 28 being skewed to be tangential to an imaginary circle having a diameter less than the diameter of the outer tips of blades 18. This is a consequence of the high velocity air or other gas exiting from the compressor having a tangential velocity component as well as a radial velocity component.

Further in accordance with the present invention, the diffuser apparatus includes means for adjusting the cross-sectional area in the diffuser housing through which the high velocity gas flows and is diffused. Specifically, the flow adjusting means includes a spike member having a contoured axisymmetric face with an axially varying cross-sectional area, with the spike being positioned within the housing along the housing axis for presenting the spike contoured face to oppose the gas flowing in the entrance to the housing. As embodied herein, spike member 40 is positioned in bore 26 along housing axis 28. In the embodiment of FIG. 1, spike 40 includes a conical asymmetric contoured face portion 42 positioned to oppose the gas flowing through the housing entrance 38.

Importantly, in conjunction with the conical housing portion 30, spike member 40 defines an annular diffusing channel portion 44, the cross-sectional flow area of which is continuously increasing in the flow direction (left to right as depicted in FIG. 1). The increasing cross-sectional flow area of channel portion 42 provides the conversion of the kinetic energy to pressure energy according to well known and understood principles of gas dynamics.

The annular diffuser created by housing portion 30 and spike member 40 is considerably shorter than a plain conical diffuser having the same cross-sectional flow area as a result of the greater diffuser surface area. Reducing overall diffuser length can be an important consideration in certain applications where weight is a controlling factor, or in applications such as the use with a radial compressor in gas turbine engine aircraft applications, where the diffuser length may influence the radial "envelope" of the engine. Also, there generally exists a fixed relationship between the diameter of the diffuser inlet and the diffuser overall length to achieve the same diffuser area ratio. For applications where the diffuser is used with a double entry centrifugal compressor having a relatively wide exit such as shown in my copending application Ser. No. 577,359, it is especially important that the diffuser length be shortened by the use of an annular diffuser such as shown in the present Figures.

With continued reference of FIG. 1, spike member 40 also has a constant diameter central portion 46 and a rear-facing contoured portion 48. Central portion 46 cooperates with the forward part of the constant diameter housing portion 34 to form a constant flow area channel portion 49 immediately downstream of the increasing flow area of portion 44. The rear-facing spike portion 48, in turn, cooperates with the constant diameter housing portion 34 to provide diffusion channel portion 50. As the cross-sectional flow area of channel portion 50 also is smoothly increasing, further diffusion can be accomplished. Spike member 40 can also be constructed without a tapered rear-facing portion, however, and such an alternative may be preferred if structural rigidity of the spike member is of concern. In the embodiment of FIG. 1, housing bore axis 28 also becomes the axis of diffuser channel portions 44, 49 and 50.

Preferably, spike member 40 is positioned along the housing axis 28 by means of rod member 52 rigidly connected to the rear-facing spike portion 48. Rod member 52, in turn, is supported by one or more bearing assemblies 54 each of which includes a plurality of struts 56 and a bearing collar 58. Bearing collar 58 should be constructed to allow sliding axial and rotary motion but prohibit radial translation motion of rod 52, for reasons which will become apparent in the succeeding discussion.

Further in accordance with the present invention, means are provided for adjusting the flow area through the housing including means for changing the axial position of the spike member in order to selectively vary the cross-sectional flow area in the diffusion channel. Adjustments in the diffuser flow area are often needed to accommodate a change in the gas mass flow rate through the associated compressor, and the particular application will dictate the frequency and extent of adjustment. For example, the use of the diffuser/compressor in a gas turbine engine-driven vehicle will necessitate more frequent changes in the diffuser area as a result of the frequent up-power and down-power maneuvers which can influence compressore mass flow rate. For large central station gas-turbine engine applications where long periods of operation at constant power are typical, the diffuser area adjustments would be made relatively infrequently to "fine tune" the compressor/diffuser assembly. The diffuser of the present invention is intended to be used in both the above-described situations.

As embodied herein, the means for changing the spike position includes rod drive means designated generally by the numeral 60 positioned outside of housing 24, which rod drive means cooperates with the end portion **52*a* of rod member 52. Rod drive means 60 not only should be able to precisely position spike member 40 when acting through rod 52, but rod drive means 60 preferably should also provide the ability to axially lock rod 52 when spike member 40 has reached a predetermined axial location. Various pneumatic, hydraulic, or mechanical control drive apparatus can be used to provide the functions of rod drive means 60**, and one skilled in the art would be able to select and adapt suitable components given the present disclosure.

Further in accordance with the present invention, the diffuser apparatus includes means for constraining the spike member against flow induced vibrations in the housing. Flow induced vibrations can occur in any object positioned in a flowing medium. Typically, a random deviation in the flow can cause a corresponding momentary deviation in the position of the object, which deviation is accompanied by a flow-induced, or resilient structure generated, force tending to restore the object to its original position. Vibrations can occur when the restoring force causes movement of the object past the original position, whereupon an oppositely directed restoring force occurs, and the process is repeated. Depending upon many factors including the momentum of the flowing medium, the restoring force (e.g. the rigidity of a structure in a bending mode, etc.) and the degree of damping, the amplitude of the vibrations and resultant stresses in the structure supporting the object can become large, leading to stress cracking and a shorter component life or even catastrophic failure of structural components.

As embodied herein, constraining means designated generally by the numeral 70 includes a combination of means designated generally 72 for imparting a torque to spike member 40 about axis 28 and also means designated generally 74 for interconnecting housing 24 and spike member 40 for opposing the imparted torque. With continued reference to FIG. 1, torque input means 72 includes splined portion 80 on rod end 52*a* and an engaging gear assembly 82 with associated gear drive/-control mechanism 84. Because of the splined connection, rod end 52*a* can move axially with respect to gear assembly 82, while remaining engaged by that assembly. Following axial movement of rod 52*a* and thus spike member 40 to a desired axial position, gear drive/control mechanism 84 can be activated to cause rotation of gear assembly 82 and a torque to be applied to spike member 40 through rod 52, 52*a* about axis 28. Preferably, during axial movement of rod portion 52*a* by drive means 60, torque input means 72 will apply only a small torque to prevent chattering of the apparatus.

Alternatively, torque input means 72 could include a helical type cam and follower assembly (not shown) which could be used in conjunction with the rod drive means 60 to provide rotation of the rod end portion 52*a* whenever rod end portion 52*a* is moved axially. Such an alternative may be preferred for applications involving only two operating axial positions for spike member 40. Additionally, other arrangements are possible, as well as other means for imparting rotation to the rod end portion 52*a*, during or after axial movement, and these other arrangements are considered within the scope of the present invention.

Figure 3:
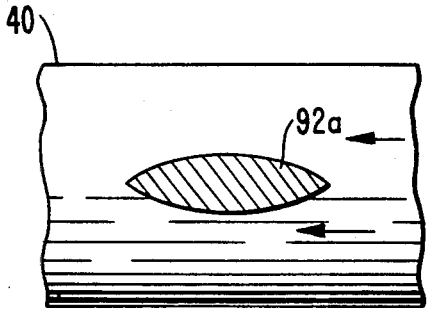
FIG. 3 is a cross-sectional view of a detail of the diffuser unit shown in FIG. 1 and taken along the line BB.

As further embodied herein, interconnection means 74 includes at least two damper guides affixed to spike member 40 and having respective tip portions extending transversely to the housing axis 28. Preferably, as shown in the FIG. 1 embodiment, a pair of damper guides 90*a,b* are rigidly fixed to diametrically opposite sides of central portion 46 of spike member 40. Damper guides 90*a,b* have respective tip portions 92*a,b* which extend transverse to axis 28 for engagement with housing 24 in a manner to be discussed below. As best seen in FIG. 3, it is preferred that the cross section of the tip portions (only tip portion 92*a* being shown in section) is aerodynamically configured in the flow direction.

Figure 2:
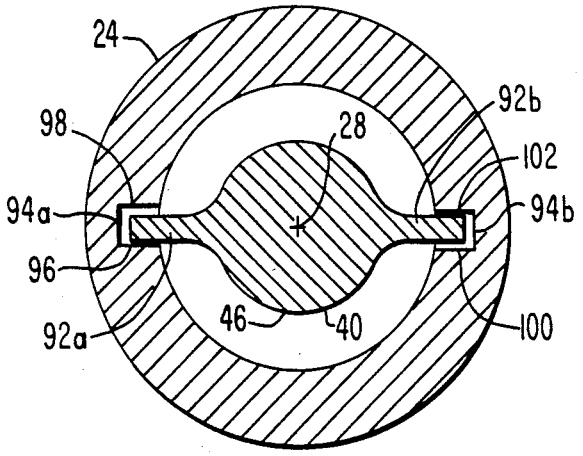
FIG. 2 is a cross-sectional view of the diffuser unit shown in FIG. 1 and taken at the line AA.

Interconnection means 74 also includes guide slots formed in the housing to receive the tip portions. As shown in FIGS. 1 and 2, a pair of guide slots 94*a,b* are formed in housing 24 to receive the tip portions 92*a,b* respectively. As best seen in FIG. 2, slot 94*a* has opposing surfaces 96, 98 for contacting tip 92*a* to oppose rotational motion in either direction and slot 94*b* has corresponding surfaces 100, 102 for contacting tip 92*b* for the same purpose.

Figure 4:
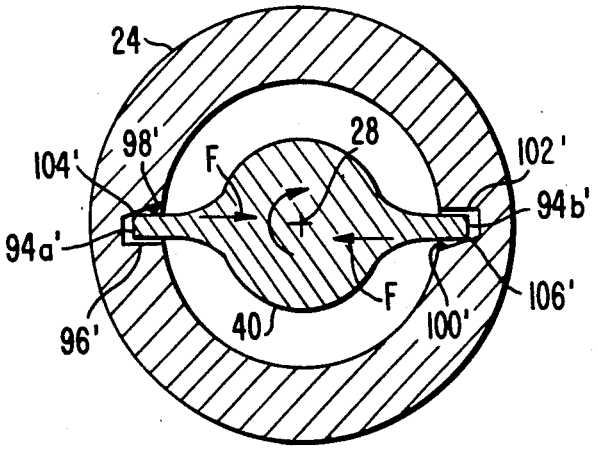
FIG. 4 is a cross-sectional view of a variation of the diffuser unit shown in FIG. 1 and taken at the line AA.

Preferably, the interconnection means also includes means for centering the spike member in the channel upon engagement between the damper guides and the guide slots. As best seen in the embodiment depicted in FIG. 4, where like numerals correspond to like elements discussed in relation to the embodiment shown in FIGS. 1–3 but where the prime designates a variation in structure, guide slot surfaces, e.g. surfaces 98' and 100' in FIG. 4, are beveled to provide opposing resultant engagement force components directed radially inward (see arrows F) and tending to center spike member 40. Also, tip engagement portions 94*a*, 94*b* have respective nib sections 104', 106' to contact beveled surfaces 98', 100' respectively. In the embodiment shown in FIG. 4, the apparatus is designed always to have a clockwise torque applied to spike member 40. However, guide surfaces 96' and 102' also could be beveled and tip portions 94*a'*, 94*b'* modified accordingly to permit spike member 40 to be torqued against the housing in the counter-clockwise direction as well.

Importantly, for the embodiments shown in FIGS. 2 and 4, the respective guide slots should extend in the axial direction beyond the end travel points of the damper guides to prevent particulate buildup interfering with the precise locating of the spike member by rod drive means 60 located outside diffuser channel 44, 49, 50.

In operation, when spike member 40 is to be moved to a different axial position, gear assembly 82 is activated to substantially untorque spike member 40. Rod drive means 60 is then activated to move spike member 40 to the new position. Next, gear drive/control mechanism 84 is again activated to rotate gear assembly 82 and rod portion 52*a*. The rotary motion is transmitted along rod member 52, to spike member 40 and to guide member tip portions 92*a,b* unitl stopped e.g. by guide surfaces 96 and 102 (see FIG. 2). Depending on the force transmitted by gear drive/control mechanism 84, more or less torque builds up primarily in rod member 52 which causes guide tips 92*a,b* to be strongly urged or biased against opposing surfaces 96, 102. This biasing causes the spike member to be held more rigidly within the diffuser housing. Furthermore, the interaction between the guide member tip portions 92*a,b* and the respective guide slots 94*a,b* can result in increased damping further tending to suppress the onset and maintenance of undesirable vibrations. A hard coating (e.g. chrome) can be applied to the guide surfaces and damper guide tip portions to prevent fretting. Unwanted wear of the guide tips and slot opposing surfaces will thus be minimized.

It will be apparent to those skilled in the art that various modifications and variations can be made in the diffusion unit of the present invention without departing from the scope or spirit of the present invention. Thus, it is intended that the present invention cover the modifications and variations of this invention provided they come within the scope of the appended claims and their equivalents.

What is claimed is:

1. Diffuser apparatus for use in conjunction with a compressor, the apparatus comprising:

(a) a housing having a diffusion channel with an axis and a cross-sectional flow area smoothly increasing in the flow direction, said housing also having an entrance for receiving gas at a relatively high velocity from the compressor, (b) means for adjusting the channel flow area, wherein said area adjusting means includes:

(i) a spike member having a contoured axisymmetric face with an axially varying cross-sectional area, said spike being positioned in said channel along the channel axis for presenting said contoured face to oppose the gas flowing in the entrance to said housing, and (ii) means for slidably positioning said spike member to selectively adjust the flow area of said channel; and (c) means for constraining said spike member against flow-induced vibrations.

2. Diffuser apparatus as in claim 1 wherein said constraining means includes means for imparting a torque to said spike member about the channel axis, and also means interconnecting said spike member and said housing for opposing said torque.

3. Diffuser apparatus as in claim 2 wherein said interconnection means includes at least two damper guides fixed to said spike member and having respective tip engaging portions extending transverse to said channel axis, and equal number of guide slots formed in said diffuser housing for slidably receiving said tip portions, each of said guide slots being sized to permit essentially only axial movement and being formed with guide surfaces for contacting said tip portion and restraining said spike member against rotational movement about the channel axis.

4. Diffuser apparatus as in claim 3 wherein the cross section of said damper guides in the flow direction is aerodynamically configured.

5. Diffuser apparatus as in claim 2 wherein said spike member is substantially torqued against said housing by said torque imparting means only when said spike member is at rest with respect to axial movement.

6. Diffuser apparatus as in claim 2 wherein said interconnection means also includes means for radially centering said spike member in said channel.

7. Diffuser apparatus as in claim 1 further including a rod member connected to said spike member and rod support means for allowing both axial and rotational movement of said rod member about the channel axis, wherein said constraining means includes means for rotating said rod member about the channel axis and means interconnecting said spike member and said housing to oppose said rotation whereby a torque-type force is generated between said spike member and said housing.

8. Diffuser apparatus as in claim 7 wherein said constraining means includes a spline portion on said rod member and drive gear means engaged thereto for imparting rotational movement and torque to said spike member.

9. Diffuser apparatus as in claim 1 wherein said diffusion channel and said spike member together provide an annular cross-sectional flow area.

10. Diffuser apparatus for use in conjunction with a centrifugal compressor, the apparatus comprising:

(a) a housing oriented substantially orthogonal to the axis of the compressor and having a diffusion channel with an axis and a cross-sectional flow area smoothly increasing in the flow direction, said housing also having an entrance for receiving gas at a relatively high velocity from the compressor;

(b) means for adjusting the channel flow area, wherein said area adjusting means includes:

(i) a spike member having a contoured axisymmetric face with an axially varying cross-sectional area, said spike being positioned in said channel along the channel axis for presenting said contoured face to oppose the gas flowing in the entrance to said housing, and (ii) means for changing the axial position of said spike member to selectively adjust the flow area of said channel; and (c) means for torquing said spike member against said housing to oppose rotational movement about the channel axis, for constraining said spike member against flow-induced vibrations, wherein said diffuser apparatus further includes a rod member connected to said spike and rod support means for allowing both axial and rotational movement of said rod member about the channel axis, wherein said torquing means includes means for rotating said rod member about the channel axis, the torque being transmitted to said spike member by said rod member, and wherein said interconnection means includes a pair of damper guides fixed to opposite transverse sides of said spike member and having tip portions extending transversely to the channel axis, and a pair of complementary guide slots formed in said diffuser housing for slidably receiving said tip portions, said guide slots being formed with opposing guide surfaces for contacting said tip portions and restraining said spike member against rotational movement about the channel axis.

11. Diffuser apparatus as in claim 10 wherein said spike member is substantially torqued against said housing by said torque importing means only when said spike member is at rest with respect to axial movement.

12. Diffuser apparatus as in claim 10 wherein said interconnection means includes means for centering said spike member in the channel axis.

13. Diffuser apparatus as in claim 12 wherein said centering means includes complementary guide surfaces being beveled to provide opposed radially inward centering forces on said rod member when it is torqued against said housing.

* * * * *